United States Patent [19]

Groseth

[11] Patent Number: 4,664,445

[45] Date of Patent: May 12, 1987

[54] TILTING MECHANISM FOR A CHAIR SEAT OR THE LIKE

[75] Inventor: Morten Groseth, Røros, Norway

[73] Assignee: HAG A/S, Norway

[21] Appl. No.: 823,485

[22] PCT Filed: May 8, 1985

[86] PCT No.: PCT/NO85/00026

§ 371 Date: Jan. 8, 1986

§ 102(e) Date: Jan. 8, 1986

[87] PCT Pub. No.: WO85/05018

PCT Pub. Date: Nov. 21, 1985

[30] Foreign Application Priority Data

May 8, 1984 [NO] Norway ..... 841843

[51] Int. Cl.[4] ..... A47C 3/026

[52] U.S. Cl. ..... 297/301; 248/371; 248/561; 248/609; 297/267; 297/270; 297/303; 297/328

[58] Field of Search ..... 297/264, 267, 270, 300–303, 297/325, 326; 248/371, 372.1, 398, 561, 573, 609

[56] References Cited

U.S. PATENT DOCUMENTS

| | | | |
|---|---|---|---|
| 2,374,350 | 4/1945 | Herold | 297/301 |
| 2,635,675 | 4/1953 | Buck . | |
| 3,430,901 | 3/1969 | Cauvin | 248/573 |
| 3,936,094 | 2/1976 | Conrad | 248/371 X |
| 4,555,085 | 11/1985 | Bauer et al. | 248/561 |

FOREIGN PATENT DOCUMENTS

| | | | |
|---|---|---|---|
| 2022525 | 11/1971 | Fed. Rep. of Germany . | |
| 2147072 | 4/1973 | Fed. Rep. of Germany | 297/303 |
| 2432248 | 1/1976 | Fed. Rep. of Germany | 297/301 |
| 275739 | 6/1951 | Switzerland | 248/609 |
| 1377 | 11/1853 | United Kingdom | 297/301 |
| 1324451 | 7/1973 | United Kingdom | 297/325 |

*Primary Examiner*—Kenneth J. Dorner
*Assistant Examiner*—Peter R. Brown
*Attorney, Agent, or Firm*—Darby & Darby

[57] ABSTRACT

A tilting mechanism for a chair seat or the like of the kind where said tilting mechanism comprises a rigid metal plate being connected to a chair support via a retaining means and where said chair seat is pivotally connected to said tilting mechanism by the aid of said retaining means, first and second flexibly resilient and coaxially arranged members e.g., rubber pads or springs, being provided for cooperation with the metal plate and the attaching frame or the like of the chair seat and both said members being provided in front of and spaced from said retaining means so that said first member is compressed when the seat is tilted backwards and that said second flexibly resilient member is compressed when the seat is tilted forwards. Said members are precompressable by the aid of an adjusting member for the adjustment of the tilting rigidity. Said tilting mechanism is provided with locking means to enable locking the seat in a forward tilted, a neutral, or a backward tilted position.

4 Claims, 2 Drawing Figures

TILTING MECHANISM FOR A CHAIR SEAT OR THE LIKE

The present invention relates to a tilting mechanism for a chair seat or the like of the kind where said tilting mechanism comprises a rigid metal plate being connected to a chair support via a retaining means, said chair seat being pivotally connected with said tilting mechanism by the aid of said retaining means, first and second flexibly resilient members, e.g. a rubber pad or a spring, being provided for cooperation with said metal plate and the attaching frame of said chair seat or the like, in such a manner that said first member is compressed when the seat is tilted backwards and that said second member is compressed when the seat is tilted forwards.

For a long time it was deemed desirable to provide a chair that may be tilted backwards as well as forwards and is in a simple manner lockable in its backwards tilted, forwards tilted, or its intermediate position. A small or large extent of forward tilting of the chair may be especially suitable for typing or for working at a worktable or the like, a maximum open angle being then achieved between the upper part of the body and the thighs.

The object of the present invention is to provide a technically simple solution of this problem. According to the invention said tilting mechanism is characterized in that both said flexibly resilient members are arranged in front of and spaced from said retaining means, said first member that is compressed when the seat is tilted backwards being provided on the lower surface of said metal plate, and the second member that is compressed when the seat is tilted forwards being provided on the top surface of said metal plate, said members being arranged coaxially and secured by a screw that extends through said members and said metal plate, the upper end of said screw being connected to the attaching frame of the chair seat and its lower end being connected to an adjusting member, whereby the preliminary compression of said members and, thus, the tilting rigidity are adjustable; and that said tilting mechanism comprises locking means to lock the seat in a forward tilted, a neutral, or a backward tilted position, said locking means comprising a stem pivotally connected to said attaching frame of the seat and extending downward through a split in the metal plate and having at least two locking pins projecting across at different levels, so that all locking pins will lie in one common level aligned with said split when the stem is turned into a first position in which the seat attaching frame may be tilted freely in relation to said metal plate and that at least one of said locking pins is brought into contact with a area on the upper or lower metal plate surface adjacent said split when the stem is turned into a second position, or that locking pins are contacting the upper or lower surface resp. of said metal plate.

Figure 1:
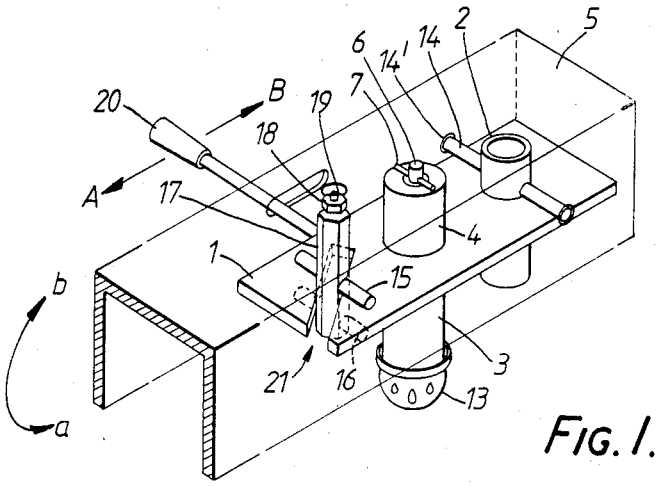
Figure 2:
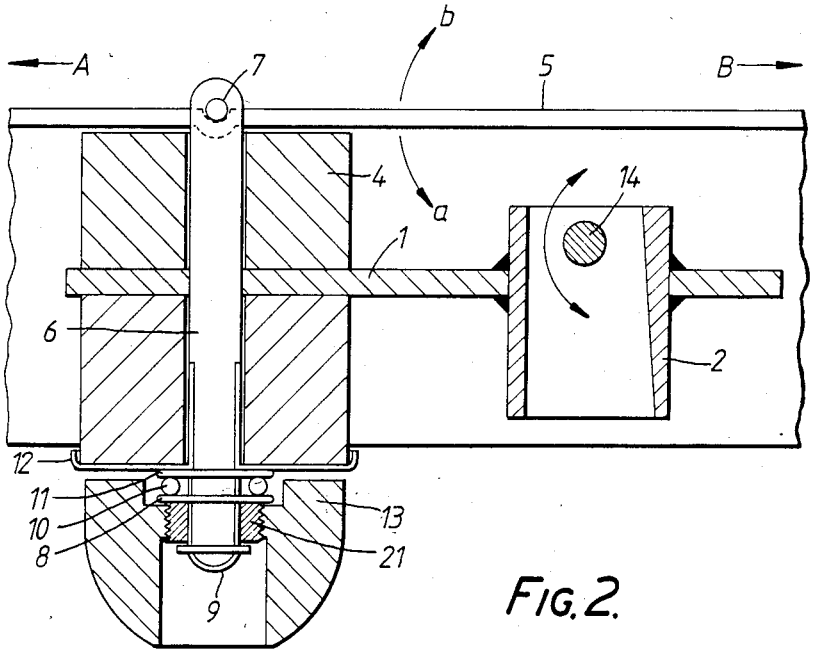

The invention will now be disclosed in more detail with reference to the accompanying drawings, wherein FIG. 1 shows the tilting mechanism according to the invention in perspective, and FIG. 2 shows an enlarged section of the tilting mechanism according to the invention.

In FIG. 1 a rigid metal plate 1 is shown and a retaining means 2 that is welded to plate 1, as clearly appearing from FIG. 2 as well. Said retaining means 2 is intended to engage a stem of a support structure, e.g. of an office chair. An attaching frame 5 is provided for the chair seat per se, and said attaching frame is transparent in FIG. 1 to simplify the drawing, although, it will be obvious that in a practical embodiment it will consist, e.g. of a rigid suitably bent metal plate. The chair seat is pivotally connected to the tilting mechanism per se by said retaining means 2, a shaft 14 protruding on each side of retaining means 2 and being supported in suitable bearings 14' in the attaching frame 5, as clearly appearing from FIG. 1. In order to ensure that the chair seat is tiltable in a controlled manner both forwards and backwards flexibly resilient member 3, 4 are provided in front of and spaced from said retaining means 2. In FIGS. 1 and 2 the arrows A and B resp. indicate the direction toward the front edge and the rear edge resp. of the seat. In a similar manner arrows a and b indicate tilting forwards and backwards respectively. Said members 3, 4 may e.g. each consist of a rubber pad or a spring, the first member 3 that is compressed when the seat is tilted backwards being provided on the lower surface of metal plate 1, and the second member 4 being compressed when the seat is tilted forwards is provided on the top surface of the metal plate. As shown in FIG. 2, said members 3, 4 are coaxial and are secured by screw 6 extending through said members and the metal plate. Corresponding holes are provided in said members and in the metal plate, preferably with a small clearance. The upper screw end is connected and locked to the chair seat frame 5 by the aid of a locking pin 7, and the lower screw end is connected to adjusting means 8–11; 13. By the aid of said adjusting means the preliminary compression of said members 3, 4 and, thus, the tilting rigidity of the seat will be adjustable. Said adjusting means inter alia comprise a head disk 8 for pressure distribution, a locking cap 9 preventing the adjusting wheel from being unscrewed. Adjusting wheel 13 is provided with a nut 21 welded into said wheel. To ensure simple operation of the adjusting wheel 13, a ball bearing 10 is provided and a steel disk 11 on top of said ball bearing. The disks 8 and 11 and the ball bearing 10 reduce frictional forces when the wheel is turned. There is also provided a head disk 12 for pressure distribution.

The advantage of being able to adjust, i.e. tighten the wheel 13 and thus increase the tension of members 3, 4 is that it is possible in this manner to compensate for the weight of the user and adapt to the user's requirement of freedom of movement in the chair. The fundamental principle is that the tilting mechanism is neutrally balanced as a starting point enabling the seat to be tilted forwards (a) or backwards (b).

Pin 7 being arranged in a little recess in the seat attaching frame 5 will prevent the screw 6 to turn in relation to said attaching frame. Furthermore, to ensure to the best possible degree that screw 6 cannot turn in relation to the attaching frame 5 and in relation to metal plate 1, the hole in said metal plate intended for screw 6 may e.g. have an oval shape, the uppermost part of screw 6 in FIG. 2 having no thread and having an oval cross section.

Retaining means 2 and plate 1 are to be considered stationary relative the tilting of the seat. Members 3 and 4, thus, be decompressed and compressed respectively when the seat is tilted forwards whereas the opposite takes place when the seat is tilted backwards. To ensure that the seat is locked in a most simple manner e.g. in its forward tilted or backward tilted position or in its central position (neutral position) a locking means is provided the structure and function of which will be disclosed below.

The locking means comprises a stem 17, e.g. a hexagon bolt, pivotally provided in the attaching frame 5. As will appear from FIG. 1, the stem 17 can be provided with two through holes across for locking pins 15, 16 and uppermost a threaded portion may be provided to be secured to the seat attaching frame 5 by the aid of a nut 19. To ensure a certain friction between the frame 5 and the stem 17 a spring plate 18 may be provided. A hand lever 20 is provided for turning stem 17 about its longitudinal axis, lever 20 being connected to stem 17. Furthermore, a slot 21 is provided in the steel plate 1, and said stem is freely movable in said slot, although with certain limitations. In FIG. 1 steel plate 1 is shown in a locked position being retained by locking pins 15, 16 on the upper and lower side respectively of plate 1. When lever 20 is moved in direction B pins 15, 16 will be able to pass freely through said slot 21 in the plate 1, and frame 5 will, thus, be able to turn about turning point 14' in relation to the stationary plate 1. Due to the fact that frame 5 is movable in relation to plate 1 said stem 17 and the locking pins 15,16 can also move in split 21 downwards or upwards dependent on whether the seat is tilting backwards or forwards. When it is desired to lock the seat in the chosen position lever 20 is moved in the direction A. In FIG. 1 the locking pins 15, 16 are shown with locking pin 15 provided on the top surface of plate 1 and locking pin 16 on the lower surface of plate 1. When the seat is locked in its forward tilted position both locking pins 15 and 16 will be found on top of the plate, locking pin 16 being in contact with plate 1. In a similar manner both locking pins 15, 16 will be found on the lower side of plate 1 when the seat is locked in its backward tilted position, locking pin 15 then being in contact with the lower surface of plate 1.

By the solution shown in FIG. 1 there are, thus, in addition to the shown central position provided two lockable positions of the seat, i.e. the chair may be locked in a forward tilted position (writing position) and a backward tilted position. With a tilting mechanism of this kind the user will have a positive feeling that the chair is properly locked in these positions, a counter pressure being achieved from said members 3 and 4 respectively as disclosed above. The number of lockable positions of the seat is, however, determined by the number of locking pins plus 1. By the aid of three or four locking pins totally four or five lockable positions are, thus, provided. The embodiment shown in FIG. 1 is, thus, not to be regarded as limiting the present invention. The possible angle of the seat will be a function of the distance between turning point 14' and locking member 17 as well as the diameter of pins 15, 16.

It will be obvious that a number of modifications of the tilting mechanism are possible within the scope of the invention. In the shown embodiment the inventor preferred to let the members 3, 4 be rubber pads. There is however, nothing preventing an exchange of the rubber pads with springs.

I claim:

1. A tilting mechanism for a chair seat, said tilting mechanism having a rigid metal plate including lower and top surfaces, a chair support, retaining means for coupling said chair support to said metal plate, an attachment frame pivotally connected to said tilting mechanism at said retaining means, first and second flexibly resilient members cooperating with said metal plate and said attachment frame such that said first flexibly resilient member is compressed when said seat is tilted backwards and said second flexibly resilient member is compressed when said seat is tilted forwards, wherein:

said first and second flexibly resilient members are arranged in front of and spaced from said retaining means, said first member being provided on said lower surface of said metal plate, and said second member being provided on said top surface of said metal plate, said first and second flexibly resilient members being arranged coaxially, said tilting mechanism further comprising a screw extending through said first and second flexibly resilient members and said metal plate, said screw having an upper end and a lower end, said upper end of said screw being connected to said attachment frame of said chair seat;

adjustment means for adjusting a preliminary compression of said first and second flexibly resilient members and for adjusting tilting rigidity, said lower screw end being connected to said adjustment member;

locking means for locking said seat in forward tilted, neutral, or backward tilted positions, said locking means comprising a stem pivotally connected to said attachment frame, said metal plate having a slot therein, said stem extending downward through said slot in said metal plate, at least two locking pins projecting across said stem at different levels, so that all locking pins will lie in a plane parallel with and extending through said slot when said stem is turned to a first position enabling said seat attachment frame to tilt freely in relation to said metal plate and so that when said stem is turned to a second position either (a) at least one of said locking pins is brought into contact with a portion on said upper or lower surfaces of said metal plate adjacent said slot or (b) adjacent locking pins are brought into contact with said upper and lower surfaces respectively of said metal plate.

2. The tilting mechanism according to claim 1, wherein said first and second flexibly resilient members comprise rubber pads.

3. The tilting mechanism according to claim 1, wherein said first and second flexibly resilient members comprise springs.

4. The tilting mechanism according to claim 1, wherein said locking means further comprises a hand lever coupled to said stem for turning said stem about said pivot in said attachment frame.

* * * * *